United States Patent [19]

DeClark et al.

[11] 4,419,875

[45] Dec. 13, 1983

[54] ARTICLE MANIPULATOR MECHANISM FOR ACCELERATED SHOT TREATING APPARATUS

[75] Inventors: Bruce W. DeClark, Walker; Joseph H. Weber, Grand Rapids, both of Mich.

[73] Assignee: Progressive Blasting Systems, Inc., Grand Rapids, Mich.

[21] Appl. No.: 300,947

[22] Filed: Sep. 10, 1981

[51] Int. Cl.[3] ..... B24C 1/10

[52] U.S. Cl. ..... 72/53

[58] Field of Search ..... 72/53, 40; 51/428, 431

[56] References Cited

U.S. PATENT DOCUMENTS

| | | | |
|---|---|---|---|
| 939,180 | 10/1909 | Ridd | 72/53 |
| 2,881,506 | 4/1959 | Fuchs | 51/439 |
| 4,067,240 | 1/1978 | Straub | 72/377 |

FOREIGN PATENT DOCUMENTS

| | | | |
|---|---|---|---|
| 143742 | 9/1980 | Fed. Rep. of Germany | 51/428 |
| 1320748 | 6/1973 | United Kingdom | 72/53 |

*Primary Examiner*—Gene P. Crosby

*Attorney, Agent, or Firm*—Price, Heneveld, Huizenga & Cooper

[57] ABSTRACT

An article or workpiece manipulator mechanism for accelerated shot treating apparatus in which workpieces are subjected to media impingement such as impingement by steel shot. The mechanism manipulates the workpieces within the path or stream of the shot so that desired surfaces of the workpieces are impacted by the shot. This is accomplished by reciprocal or continuous rotation of the workpiece by the manipulator mechanism and also the angle at which the workpiece is held while being rotated can be adjusted by the mechanism.

16 Claims, 9 Drawing Figures

ARTICLE MANIPULATOR MECHANISM FOR ACCELERATED SHOT TREATING APPARATUS

BACKGROUND OF THE INVENTION

This invention relates to the treatment of articles or workpieces by means of subjecting them to media impingement; for example, the treatment of turbine blades by shot peening. More particularly, this invention relates to mechanism for manipulating the articles or workpieces within the path or stream of gravity accelerated media such as steel shot.

The present invention is related to the apparatus as disclosed in patent application Ser. No. 300,948, entitled GRAVITY ACCELERATED SHOT TREATING APPARATUS, filed Sept. 10, 1981, and having inventors and the assignee in common with the above-identified patent application, apparatus for shot peening comprises the impacting of articles or workpieces with uniformly sized spherical steel shot accelerated by the force of gravity created by the shot freely falling in space.

In such patent application, a perforated plate or screen is provided from which the shot falls on the article or workpiece to be treated. The object of the method and apparatus disclosed in such patent application is to uniformly treat predetermined surfaces of the workpieces in a uniform manner so that each workpiece is subjected to the same peening intensity. Also, it is important that in certain workpieces, such as turbine blades, the workpiece be oriented properly, i.e., that certain surfaces be exposed to the impact of the shot without deleterious effect on other parts of the blade. This requires that the workpiece be rotationally oscillated to allow uniform finishing of the thin contoured pieces of airfoil configuration. Further, the impingement angle of the shot is important and, therefore, it is necessary that the blades be arranged at a predetermined angle as they are oscillated. The angle at which the blade is held in the stream varies with its shape, particularly when irregular shapes such as shoulders and the like are to be peened.

Also, as disclosed in the above-identified application, it is desirable to uniformly shot peen a multiple of workpieces in one operation. Consequently, there has been a need for an improved mechanism for holding and manipulating the workpieces within the stream of the treating media, it being important that the workpieces can be rotated and the inclination thereof varied for treating the surfaces of a variety of different shapes and sizes of workpieces.

SUMMARY OF THE INVENTION

In accordance with the present invention, we have solved this need for a reliable article manipulator mechanism by which the desired surfaces of the workpieces can be treated by a stream of media such as steel shot.

In accordance with the invention, a fixture means, projecting into the housing toward the path of a stream of accelerated media, is mounted on an enclosure panel. The fixture means has a holder for holding the workpiece in the path of the stream of accelerated media. At the other end of the fixture means, located on the outer side of the enclosure panel, is mounted a motor means operatively connected to the shafts of the fixture means for rotating the same.

In the preferred form of our invention, the panel means is a door which is mounted over an opening into the enclosed housing. This permits the workpieces to be easily mounted on and removed from the holders. In even a more preferred embodiment of this invention, two doors are provided to be opened and closed interchangeably whereby when one door is closed and the workpieces are being treated inside the housing, treated workpieces can be removed from the holder means on the other door and replaced by untreated workpieces.

In a particular embodiment of the invention suited for use in the treatment of a multiplicity of workpieces in one operation, a plurality of rotatably mounted fixture means project through the enclosure panel and on the outer end of the fixture means, i.e., on the outer side of the panel. A gear and rack arrangement is provided with a reciprocating motor means for reciprocating the rack. Thus, the spindles of the fixture means are reciprocally rotated by the gear and rack arrangement. In this embodiment, the speed of rotation, the distance of the reciprocation of the rack and the dwell time between each reciprocal movement is controllable to produce the desired peening of the surfaces of the workpieces.

Also in accord with this invention, a unique mechanism is provided for adjusting the angular position of the workpiece within the housing. This unique mechanism mounts the fixtures, the holders, and the motor driver means including the rack and gear arrangement on a single support that is mounted for rotational adjustment about an axis extending within the enclosure panel substantially lengthwise of but spaced parallel to the stream of accelerated media. This adjustment of the entire mechanism about such an axis makes for a quick and simple adjustment of the mechanism for holding different sizes and shapes of workpieces. The control of the reciprocal rotation of the fixtures and holders also provides for a simple adjustment of the same so that the same apparatus can be used to treat various sizes and shapes of workpieces.

These and other objects, advantages, and features of the invention will be more fully understood and appreciated by reference to the written specification made in conjunction with the appended drawings.

DESCRIPTION OF THE PREFERRED EMBODIMENT

Figure 1:
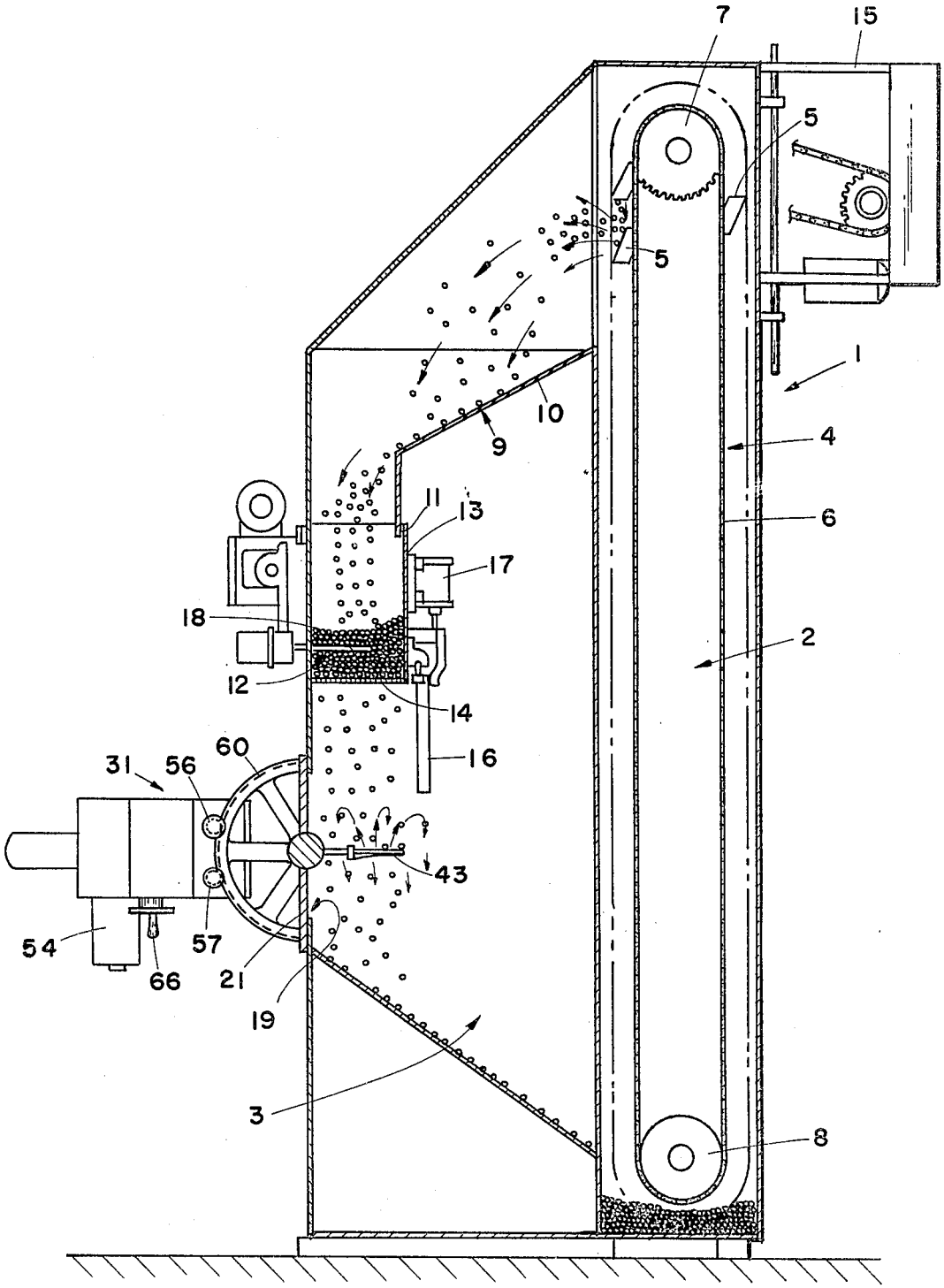
FIG. 1 is a side elevational, cross-sectional view of a sketch of the entire apparatus of which this invention is a part.

Referring specifically to the drawings, reference numeral 1 designates the housing for the apparatus. Housing 1 includes two chambers, an elevator chamber 2 and a blasting chamber 3 (it being understood that blasting is used in a broad sense in that in this particular apparatus the treatment of the workpieces is by a free-falling gravity accelerated media). Located within the elevator chamber is the elevator assembly 4 having a plurality of elongated buckets 5 extending substantially along the entire width of the chamber 2 and mounted on spaced endless chains 6 which ride on the conventional sprocket 7 and toothless sprocket 8. The elevator 4, driven by the elevator drive assembly 15, picks up the media, which preferably comprises steel shot, and elevates the same to deliver the shot into the blasting chamber 3.

The blasting chamber includes a funnel-like member 9 at the top thereof having the inclined wall 10 terminating into a flange 11 that fits into and directs the shot into a bucket assembly 12. The bucket assembly includes the bucket 13 having mounted in its bottom a preforated metal plate or screen 14. At one edge of the bucket 13, is pivotally mounted a bucket door which is adapted to be opened and closed by the air cylinder 17. Also mounted in the bucket are probes 18 which sense the level of the media or shot in the bucket.

It should be understood that the construction of the elevator assembly and the bucket assembly is disclosed in our pending patent application Ser. No. 300,948, entitled GRAVITY ACCELERATED SHOT TREATING APPARATUS, and filed on Sept. 10, 1981, and that such construction disclosed in that patent application is to be incorporated by reference in this application.

The chamber 3 has an opening 19 with two doors 20 and 21 (FIGS. 2 and 3) interchangeably closing the same. These two doors 20 and 21 are identical except that one is a right hand door and the other is a left hand door. Each of these doors constitutes an enclosure panel on which the manipulating mechanism assembly 30 or 31 is mounted. Although within the preferred embodiment of this invention the assemblies 30 and 31 are mounted on the doors 20 and 21, respectively, it should be understood that within the broader aspects of this invention such assemblies could be mounted on a stationary enclosure panel without deviating from the broader aspects of this invention.

Figure 2:
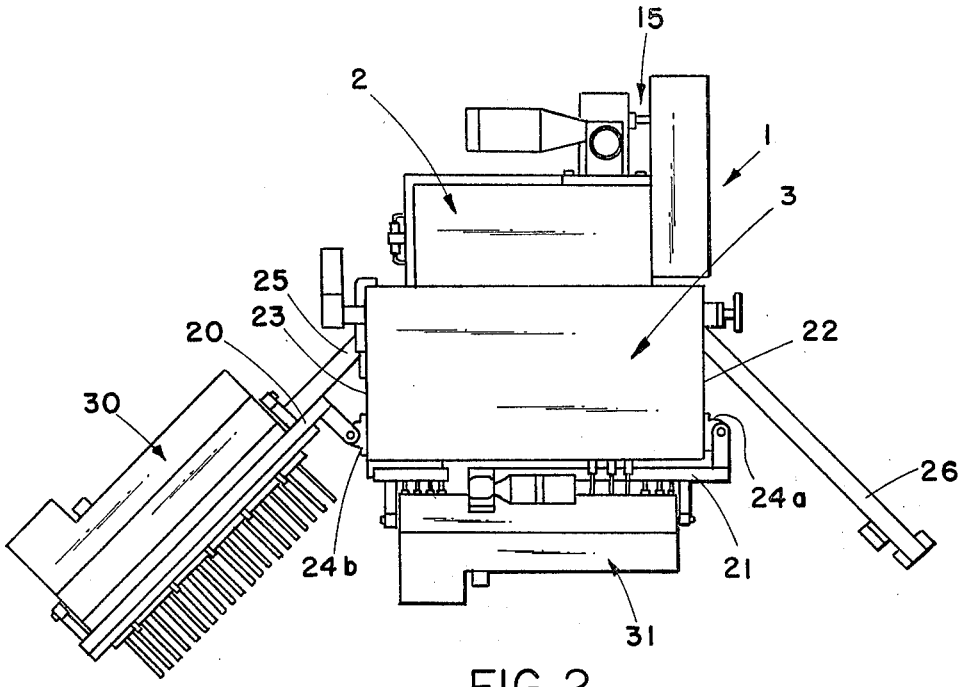
FIG. 2 is a plan view of the apparatus showing the two doors with one closed and the other open.

In the preferred embodiment, two doors 20 and 21 are provided having manipulator mechanism assemblies 30 and 31, respectively. The doors are mounted on opposite sides 22 and 23 by means of the hinges 24 and 25. The panels of the door are offset from the hinge axes so that when one door is open as disclosed in FIG. 2, the other door can be completely closed over the opening 19. Further, on each side are provided the supports 25 and 26, respectively, for supporting and holding the door in open position. Thus, door 20 is held in its open position by the support 25 while the door 21, as shown in FIG. 2 is closed. Likewise, if door 20 is closed, door 21 is held in open position by the support 26.

The essence of our invention covered by this patent resides in the manipulator mechanism assemblies 30 and 31 which are essentially identical, the only difference being that the drive and reducer subassembly of the assembly 30 is located on the right whereas the drive and reducer subassembly of the assembly 31 is located on the left. Only the construction of the assembly 31 will be described in that such description will make obvious to one skilled in the art the construction of assembly 30.

Figure 3:
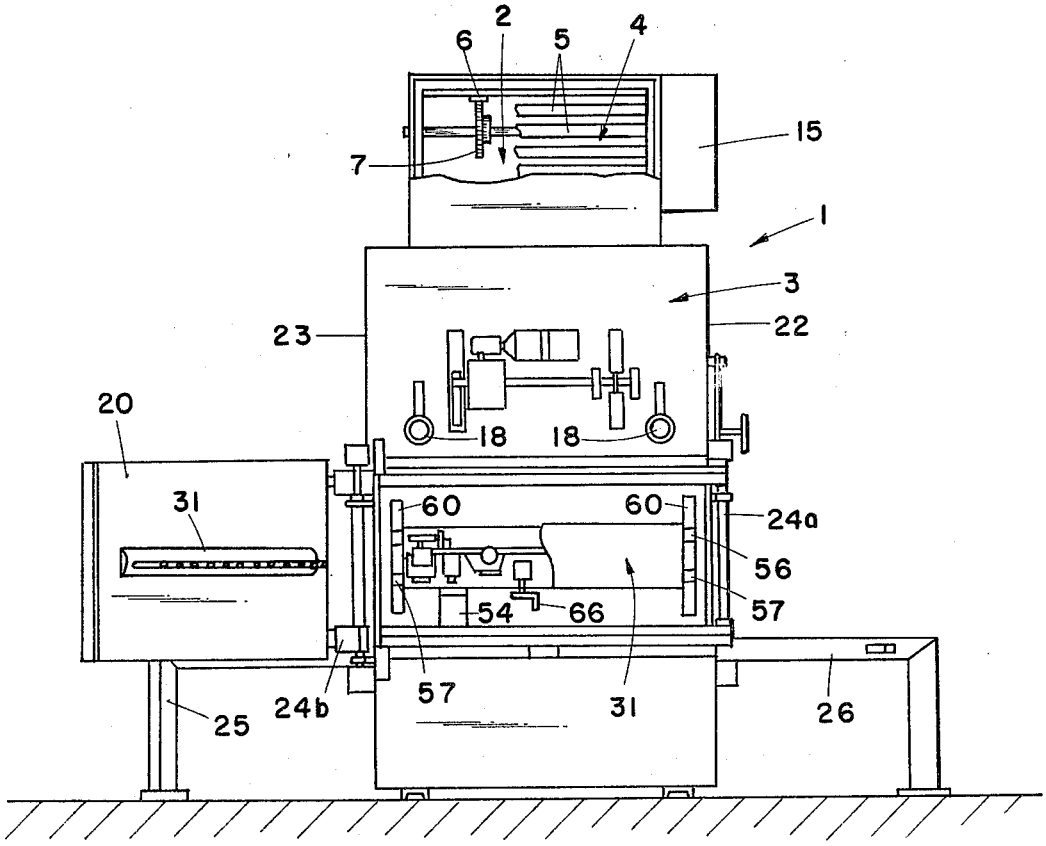
FIG. 3 is a front elevational view of the apparatus of this invention with the one door open and the other closed.

Having broadly described that assembly 31 is mounted on a door 21, as disclosed in FIGS. 2 and 3, reference is now made to FIGS. 4–8 which disclose in more detail the construction of the assembly 31 and how the manipulator mechanism assembly 31 is mounted on the door 21. The primary support member is the cylindrical fixture bar 32 rotatably mounted on the panel 33 of door 21 by means of the brackets **34*a*, 34*b*, 34*c*, 34*d* and 34*e*. As disclosed in FIGS. 5 and 8, these brackets each have an inner bracket plate 35 and an outer bracket plate 36 welded to the panel 33 and shaped to rotatably receive the fixture bar 32** lengthwise across the width of the door.

At each end of fixture bar 32 is a side support member 37 extending outwardly of bar 32 and having at its outer end a flange 38 secured to and supporting the support housing 39 for the entire remainder of the mechanism.

Figure 4:
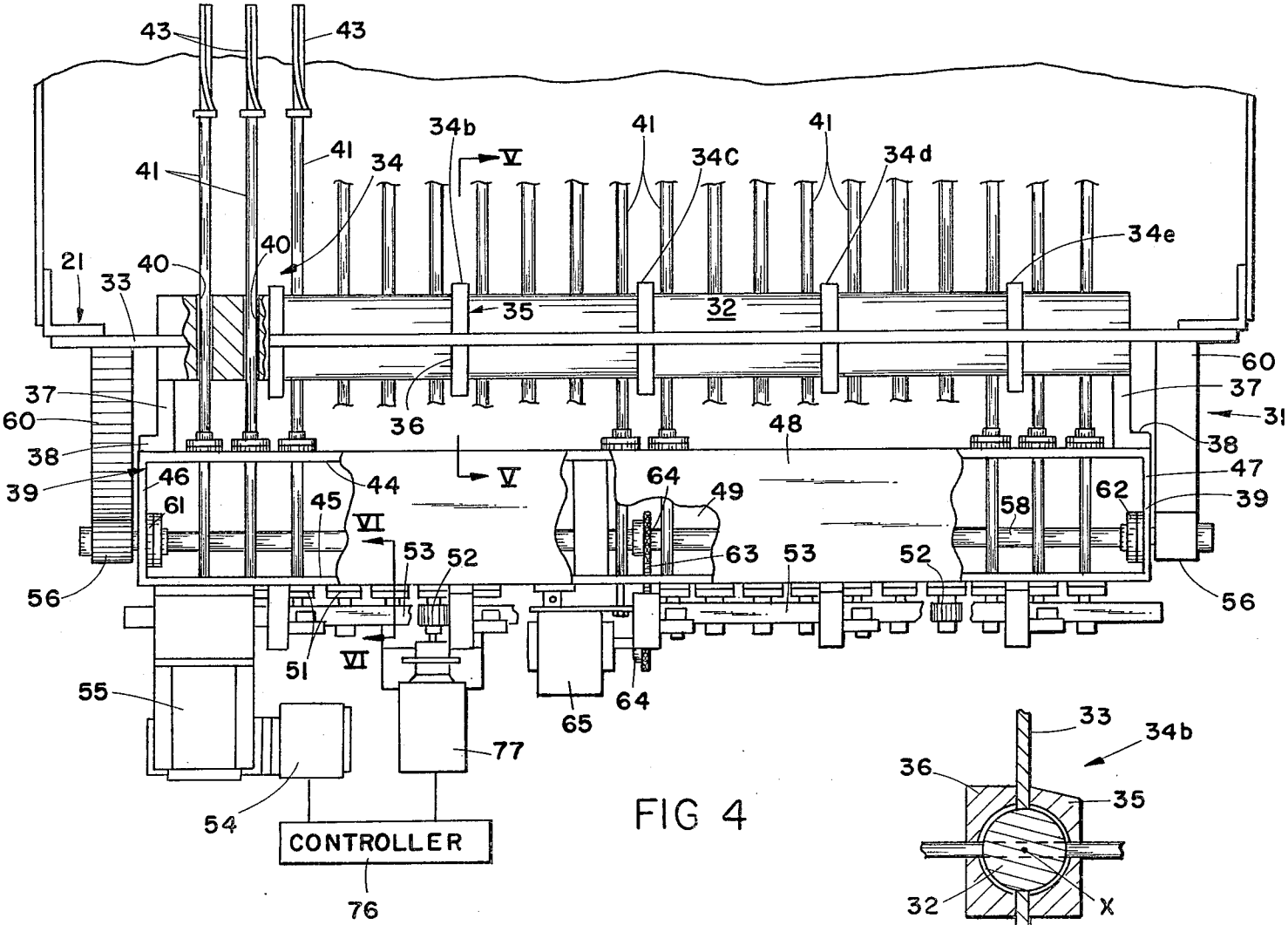
FIG. 4 is a top plan view, partially cross-sectioned and partially cut away, of the mechanism for manipulating the workpieces treated by the apparatus of this invention.

Extending through spaced openings 40 along the entire length of the fixture bar 32 is a plurality of fixture shafts 41 having one end extending into the blasting chamber 3 of housing 1 and the other end extending outside the chamber through the support housing 39. A holder means 42 is provided at the inner end of the shaft 41 to hold such objects as a turbine blade (FIG. 4). The outer ends of the shafts 41 are operatively connected to a means for rotatably driving the same, such means being supported by the support housing 39. Housing 39 comprises two spaced plates 44 and 45 held in spaced relationship by the end plates 46 and 47, top plate 48 and bottom plate 49.

The outer ends of the shafts 41 extend through the housing 39 and are mounted for rotational movement by the bearing 50 mounted on rear plate 44 and bearing 51 mounted on the front plate 45. Gears 52 are mounted on the extreme ends of each of the shafts 41 and are engaged by the rack 53 providing a means for reciprocally rotating the shafts 41. The rack 53 is reciprocally driven by the motor 54 through the gear reducer 55.

The motor 54 is of a specific design manufactured and sold by Compumotor Corporation of Petaluma, Calif., that can be adjusted for reciprocal rotation, speed and the dwell time between each reciprocal movement. A controller system is provided for this purpose, such system including the controller panel 56 and an encoder resolver 57 which monitors the speed, the amount of reciprocation, and the dwell time between each reciprocal movement of one of the gears 52 (see FIG. 4) and feeds this information back to the controller panel 56 to assist in the control. Control systems of this type are conventional and used in various well-known equipment and, therefore, need no further description since it is within the purview of one skilled in the art.

It will be evident from the above description of the mechanism 31 that the motor 54 reciprocates the rack 53 at a predetermined speed, distance, and dwell time between each reciprocation. This causes the gears to reciprocally rotate the shafts 41 for the proper treatment of the workpieces by the gravity accelerated shot falling downwardly from bucket assembly 12 (FIG. 1).

Figure 5:
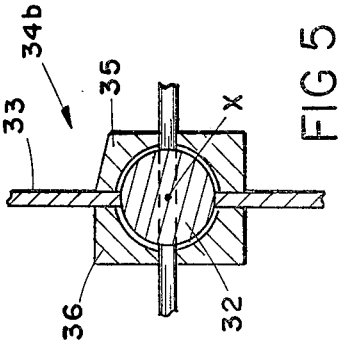
FIG. 5 is a cross section taken along the plane V—V of a small section of the mechanism in FIG. 4 and specifically showing the means for mounting the fixture bar on the door of the apparatus, which bar makes possible the adjustment of the angle at which the workpiece is held within the media stream inside the housing.
Figure 6:
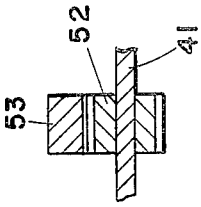
FIG. 6 is a cross section taken along the plane VI—VI of a segment of the mechanism of FIG. 4 and illustrating the rack and gear drive for the fixture shafts.
Figure 8:
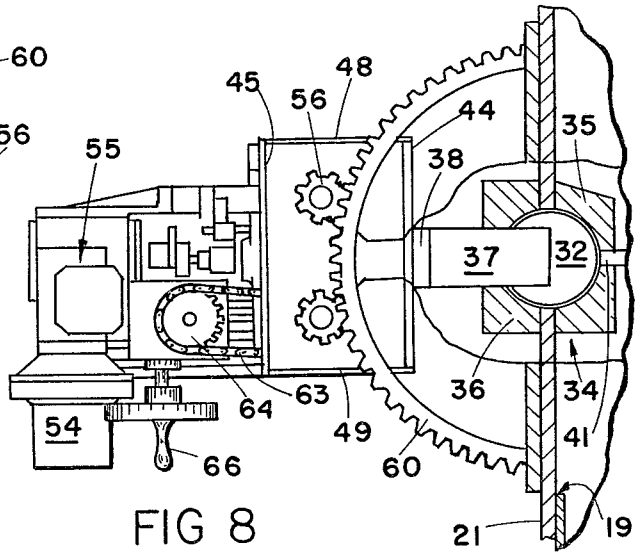
FIG. 8 is a side elevational view, partially cut away, of the mechanism as disclosed in both FIGS. 4 and 7.
Figure 7:
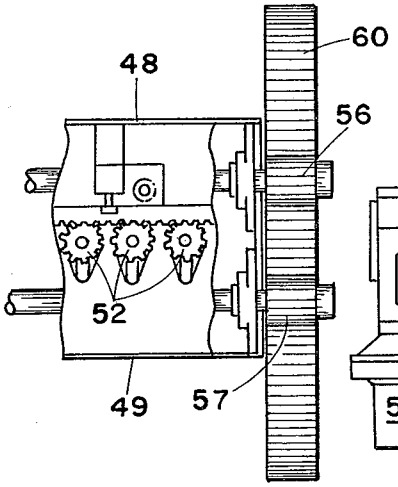
FIG. 7 is a front elevational view of the mechanism of FIG. 4.
Figure 7:
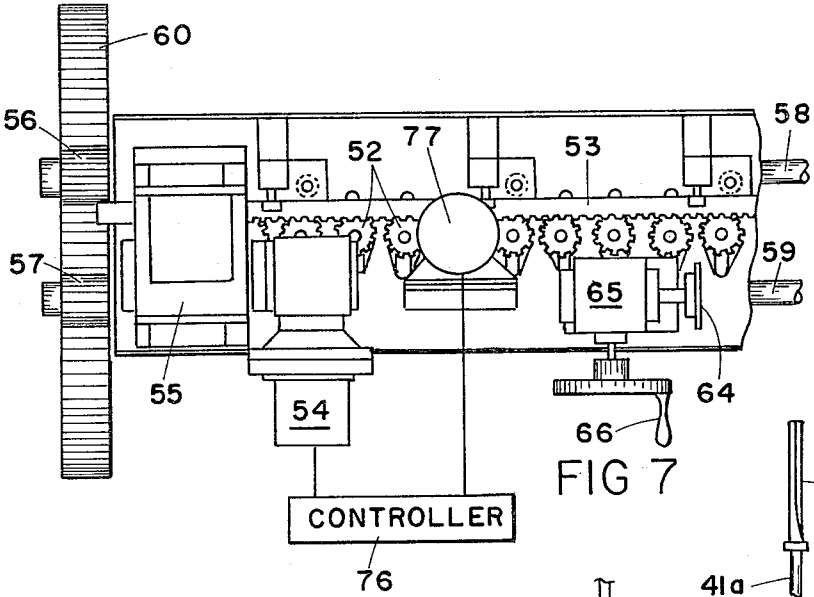

As previously stated, it is desirable that the workpieces be held at different angles within the blasting chamber 3 depending upon the particular shape and work to be done on the workpiece. This is accomplished by means of the combination of fixture bar 32, guide supports 37 and support housing 39 including the mechanism it supports, all of which are rotatable as a unit about the axis X of the cylindrical bar 32 (FIGS. 5 and 8). Thus, the entire assembly 31 is rotatable about the axis X for adjusting the angle of the fixture shafts 41.

Semicircular gear sectors 60, combined with the gears 56, 57 mounted on the shafts 58, 59 extending through the housing 39, provide the means for adjusting the angle of the assembly 31 and holding it in the adjusted position. The gear shafts 58 and 59 extend through the housing 39 and are rotatably mounted therein by the bearings 61 and 62. Gear 56 is an idler gear engaging the teeth on the outer side of the gear sector 60. Gear 57 is a gear driven by the chain 63 passing around the sprocket 64 and driven by the reducer gear 65 by means of a manual handwheel or crank 66. Thus rotational movement of the handwheel or crank 66 causes rotation of the gear 57 which meshes with the teeth of the gear sector 60 causing adjustment of the entire mechanism 31 to determine the angle of the fixture shafts 41.

OPERATION

Having described the various details of the apparatus disclosed in the drawings, the operation thereof should be quite evident. Referring to FIG. 1, it should be clear that the apparatus is supplied with the treating media, preferably metal shot. This media is elevated upwardly through the elevator chamber 2 by means of the elevator 4 causing the shot to be dispensed into the chute 9 where it falls into the bucket assembly 12. The shot passes through the screen 14 unless shut off by actuation of the cylinder 17 which closes the bucket door 16. The events that cause such closing of the bucket door 16 would be when both doors are open and there is no workpiece in position to be treated. Further, the bucket door 16 closes when the probe 18 located within the bucket assembly senses a low supply of shot or uneven distribution of shot across the width of bucket assembly 12. Assuming everything is in order and the door 16 is open, the shot falls through the screen 14 and impinges upon the workpieces 43 held in proper position within the blasting chamber 3 by the manipulator mechanism assembly 31. The shot then falls downwardly into the elevator chamber 2 after which it is elevated and the process repeated.

As previously stated, the present invention is related to the mechanism for manipulating the articles in the path of the gravity accelerated media so that the workpiece is held in the proper position and is moved to properly treat the surfaces. The mechanisms 30 and 31 are provided for this purpose. These operate by first adjusting the angular position of the workpiece holders within the blasting chamber. This is accomplished by rotating the handwheel or crank 66 causing turning of the sprocket 67 connected to the reducer gear 65. This in turn, by means of the chain 63, causes rotation of the gear 57 which rides on the teeth of the gear sector 60 to adjust the entire assembly 31 about the axis X of the cylindrical bar 32 into the proper angular position.

Having adjusted the fixture shafts 41 to the proper angular position and with the door 21 or 25 closed, the motor 54 is put into operation which reciprocally drives the rack 53 at a speed, distance, and with a dwell time between each reciprocation as determined by the setting of the controller 56. The reciprocation of the rack 53 reciprocally rotates the gear 52 which in turn reciprocally rotate the shafts 41, the holders 42 and the workpieces 43, it being understood that in FIG. 4 only one workpiece is shown in order to simplify the drawings. In the operation of the controller, the encoder resolver 77 connected to one of the gears 52 feeds back a signal to the controller panel 56 to provide the necessary control.

While the workpieces 43 are being reciprocally rotated and held at a predetermined angle to the stream of shot falling downwardly from the bucket assembly 12, the shot strikes the surfaces of the workpiece treating the same. Preferably this treatment is to compress and smooth the surfaces of turbine blades used in jet engines but the apparatus can be for many other purposes.

MODIFICATION

Figure 9:
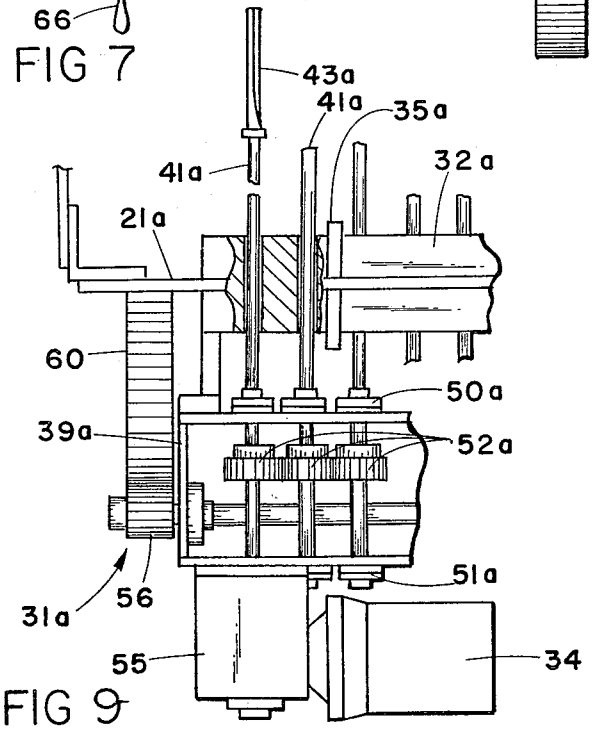
FIG. 9 is a partial top plan view similar to FIG. 4 but modified to provide a mechanism for continuously driving the fixture shafts so that the workpieces are continuously rotated rather than reciprocally rotated.

FIG. 9 shows a modification of the apparatus disclosed above for use in those instances where it is desirable to continuously rotate the workpiece, designated therein by reference numeral 43*a*. In this modification, substantially all of the elements are identical except for the driving means for the spindles. Thus, there is provided a cylindrical bar 32*a* supported by the brackets 35*a* on the door 21*a* and through which extend fixture shafts 41*a*. The shafts are rotatably mounted on the housing 39*a* by means of the bearings 50*a* and 51*a*. The primary difference of this modification over that mechanism previously described is that the driving gears 52*a* driven by the motor 54*a* and reducer 55*a* all intermesh so that there is continuous rotation of the shafts 41*a*. Although the preferred embodiment of this invention is that as disclosed above in relation to FIGS. 1–8, this manipulator mechanism assembly 31 should be considered as falling within the broader aspects of our invention. The operation of the mechanism of FIG. 9 should be quite evident from comparing it with the description of the mechanism 31.

It should be understood that the above description is intended to be that of a preferred embodiment of the invention. Various changes and alterations might be made without departing from the spirit and broader aspects of the invention as set forth in the appended claims, which are to be interpreted in accordance with the principles of patent law, including the doctrine of equivalents.

The embodiments of the invention in which an exclusive property or privilege is claimed are defined as follows:

1. Mechanism for manipulating articles in the path of a stream of media created by vertical free-falling gravity accelerated media for treating such articles by said media impinging on the same corresponding predetermined portions of surfaces of said articles, said path being directed downwardly and located within an enclosed housing having an opening closed by an enclosure panel means forming part thereof, comprising:

a plurality of rotatably mounted fixture means projecting from said enclosure panel into said housing toward the said path of said accelerated media and each having article holder means at one end for holding an article to be treated in said path; said fixture means being mounted on said enclosure panel means, and said holder means extending inwardly thereof, common driver means operatively connected to the other ends of each of said fixture means on the outer side of said enclosure panel means for rotating said fixture and holder means inside said housing, said driver means including a motor means operatively connected to each of said fixture means so as to rotate all of said fixtures and holder means in unison whereby predetermined surfaces of the articles held by said holder means are exposed in a uniform manner to said falling stream of media so that each article is subjected to the same peening intensity.

2. The mechanism of claim 1 in which the enclosure panel means is a door mounted on said housing for closing an opening in said housing whereby articles can be placed in said holder means when the door is open and when closed the fixture means project into said housing wherein such holder means holds such articles in the path of the said media.

3. The mechanism of claim 2 in which two separate doors are provided each having said fixture means, holder means, and driver means, said doors being mounted on said housing to be closed interchangeably whereby when one door is closed and articles are being treated inside the housing, treated articles can be removed from the holder means on the other door and be replaced by untreated articles.

4. Mechanism for manipulating articles in the path of a stream of media accelerated for treating such articles by impinging on predetermined portions of surfaces of said articles, said path being located within an enclosed housing having an enclosure panel means forming part thereof, comprising:

a plurality of rotatably mounted fixture means projecting into said housing toward the said path of said accelerated media and each having article holder means at one end for holding an article to be treated in said path; said fixture means being mounted on said enclosure panel means, and said holder means extending inwardly thereof;

driver means at the other end of said fixture means and located on the outer side of said enclosure panel means for rotating said fixture and holder means inside said housing, said driver means including a motor means operatively connected to each of said fixture means; and said driver means including a gear on the end of each fixture means; a reciprocating rack engaging the gears for reciprocally rotating the gears and said holder means, said rack being reciprocally driven by said motor means.

5. The mechanism of claim 4 in which the motor means has a reciprocal driving means for reciprocating said rack and control means for controlling the distance of reciprocation whereby the rotatable reciprocation of said holder means can be adjusted.

6. The mechanism of claim 5 in which said control means also includes means for controlling the speed of rotational reciprocation and the time interval between the rotational reciprocations of said holder means.

7. Mechanism for manipulating articles in the path of a stream of media accelerated for treating such articles by impinging on predetermined portions of surfaces of said articles, said path being located within an enclosed housing having an enclosure panel means forming part thereof, comprising:

a plurality of rotatably mounted fixture means projecting into said housing toward the said path of said accelerated media and each having article holder means at one end for holding an article to be treated in said path; said fixture means being mounted on said enclosure panel means, and said holder means extending inwardly thereof;

driver means at the other end of said fixture means and located on the outer side of said enclosure panel means for rotating said fixture and holder means inside said housing, said driver means including a motor means operatively connected to each of said fixture means; and said driver means including a gear on the end of each fixture means, said gears engaging each other and driven by said motor means causing continuous rotation of said holder means.

8. Mechanism for manipulating articles in the path of a stream of media accelerated for treating such articles by impinging on predetermined portions of surfaces of said articles, said path being located within an enclosed housing having an enclosure panel means forming part thereof, comprising:

a plurality of rotatably mounted fixture means projecting into said housing toward the said path of said accelerated media and each having article holder means at one end for holding an article to be treated in said path; said fixture means being mounted on said enclosure panel means, and said holder means extending inwardly thereof;

driver means at the other end of said fixture means and located on the outer side of said enclosure panel means for rotating said fixture and holder means inside said housing, said driver means including a motor means operatively connected to each of said fixture means; and an elongated rotatable cylindrical member mounted in said enclosure panel means, said fixture means extending radially through said cylindrical member; and means for varying the inclination of said fixture means about the axis of said cylindrical member whereby the angle of inclination of said holder means can be varied to vary the angle of inclination of workpieces held by said holder means inside said housing.

9. The mechanism of claim 8 in which a support means secured to said cylinder extends outwardly of the enclosure wall means of said housing; said driver means being supported by said support means whereby the driver means, fixture means, and holder means are moved together as one unit when the angle of inclination of said holder means is varied.

10. The mechanism of claim 9 in which an arcuate gear sector means is mounted rigidly on the outer side of said enclosure wall means, the arc of said sector having its center of radius at the axis of said cylinder; spur gear means mounted on said support means and engaging the said gear sector means; and means for driving said spur gear means for adjusting the inclined position of said driver means, fixture means and holder means on said enclosure panel means.

11. Mechanism for manipulating articles in the path of a stream of media accelerated for treating such articles by impinging on predetermined portions of surfaces of said articles, said path being located within an enclosed housing having an enclosure panel means forming part thereof, comprising:

a plurality of rotatably mounted fixture means projecting into said housing toward the said path of said accelerated media and each having article holder means at one end for holding an article to be treated in said path; said fixture means being mounted on said enclosure panel means, and said holder means extending inwardly thereof;

driver means at the other end of said fixture means and located on the outer side of said enclosure panel means for rotating said fixture and holder means inside said housing, said driver means including a motor means operatively connected to each of said fixture means; and rotatable support means on said enclosure panel means extending in a horizontal direction spaced from and extending at least across the width of said media stream; said fixture means, holder means, and driver means being supported by said rotatable support means whereby the fixture means, holder means, and driver means are rotatable in unison about the axis of said rotatable support means for adjusting the angle at which said holder means holds said articles in said media stream.

12. The mechanism of claim 11 in which the driver means includes a gear on the end of each fixture means; a reciprocating rack engaging the gears for reciprocally rotating the gears and said holder means, said rack being reciprocally driven by said motor means.

13. The mechanism of claim 11 in which the driver means includes a gear on the end of each fixture means, said gears engaging each other and driven by said motor means causing continuous rotation of said holder means.

14. The mechanism of claim 12 in which the motor means has a reciprocal driving means for reciprocating said rack and control means for controlling the distance of reciprocation whereby the rotatable reciprocation of said holder means can be adjusted.

15. The mechanism of claim 14 in which said control means also includes means for controlling the speed of rotational reciprocation and the time interval between the rotational reciprocations of said holder means.

16. The mechanism of claim 12 in which an arcuate gear sector means is mounted rigidly on the outer side of said enclosure wall means, the arc of said sector having its center of radius at the axis of said rotatable support means; spur gear means mounted on said support means and engaging the said gear sector means; and means for driving said spur gear means for adjusting the inclined position of said driver means, fixture means and holder means on said enclosure panel means.

* * * * *